US006059957A

United States Patent [19]

Khan et al.

[11] Patent Number: 6,059,957

[45] **Date of Patent: *May 9, 2000**

[54] METHODS FOR ADDING VALUE TO HEAVY OIL

[75] Inventors: Motasimur Rashid Khan, Wappingers Falls; Steven Jude DeCanio, Montgomery, both of N.Y.

[73] Assignee: Texaco Inc., White Plains, N.Y.

[ * ] Notice: This patent is subject to a terminal disclaimer.

[21] Appl. No.: 08/929,928

[22] Filed: Sep. 15, 1997

Related U.S. Application Data

[60] Provisional application No. 60/026,193, Sep. 16, 1997.

[51] Int. Cl.[7] ..... C10G 47/02

[52] U.S. Cl. ..... 208/108; 208/113

[58] Field of Search ..... 208/108, 113

[56] References Cited

U.S. PATENT DOCUMENTS

| | | | |
|---|---|---|---|
| 2,614,066 | 10/1952 | Cornell | 186/28 |
| 3,544,291 | 12/1970 | Schlinger et al. | 48/206 |
| 3,694,344 | 9/1972 | Munro | 208/108 |
| 3,694,374 | 9/1972 | Sparks | 252/400 |
| 3,847,564 | 11/1974 | Marion et al. | 48/95 |
| 4,209,685 | 6/1980 | Khulbe et al. | 208/48 |
| 4,252,634 | 2/1981 | Khulbe et al. | 208/48 |
| 4,299,687 | 11/1981 | Myers et al. | 208/113 |
| 4,309,753 | 1/1982 | Negi et al. | 364/200 |
| 4,347,122 | 8/1982 | Myers et al. | 208/113 |
| 4,354,923 | 10/1982 | Myers et al. | 208/113 |
| 4,370,221 | 1/1983 | Patmore et al. | 208/112 |
| 4,419,223 | 12/1983 | Myers et al. | 208/120 |
| 4,432,864 | 2/1984 | Myers et al. | 208/120 |
| 4,434,044 | 2/1984 | Busch et al. | 208/91 |
| 4,435,279 | 3/1984 | Busch et al. | 208/111 |
| 4,444,651 | 4/1984 | Busch et al. | 208/120 |
| 4,464,250 | 8/1984 | Myers et al. | 208/120 |
| 4,525,175 | 6/1985 | Stellaccio | 48/86 |
| 4,569,753 | 2/1986 | Busch et al. | 208/73 |
| 4,582,120 | 4/1986 | Walters et al. | 165/104.16 |
| 4,605,646 | 8/1986 | Walters et al. | 502/39 |
| 4,716,958 | 1/1988 | Walters et al. | 165/142 |
| 4,822,761 | 4/1989 | Walters et al. | 502/38 |
| 4,894,141 | 1/1990 | Busch et al. | 208/73 |
| 4,923,838 | 5/1990 | Khulbe et al. | 502/151 |
| 4,963,247 | 10/1990 | Belinko et al. | 208/112 |
| 5,045,226 | 9/1991 | Richter et al. | 252/182.2 |
| 5,104,516 | 4/1992 | de Bruijn et al. | 208/107 |
| 5,322,617 | 6/1994 | de Bruijn et al. | 208/108 |
| 5,436,215 | 7/1995 | Dai et al. | 502/317 |
| 5,445,659 | 8/1995 | Khan et al. | 48/197 |
| 5,457,256 | 10/1995 | Mitariten et al. | 585/655 |
| 5,935,419 | 10/1999 | Khan et al. | 208/108 |

FOREIGN PATENT DOCUMENTS

| | | | |
|---|---|---|---|
| 1124195 | 5/1982 | Canada | 3/34 |
| 1195639 | 10/1985 | Canada | 47/4 |

*Primary Examiner*—Walter D. Griffin
*Assistant Examiner*—Nadine Preisch
*Attorney, Agent, or Firm*—Harold J. Delhommer; Arnold, White & Durkee

[57] ABSTRACT

A process of the conversion of a heavy hydrocarbon into a lighter hydrocarbon utilizing a soluble transition metal salt and synthesis gas which includes soot particles and other impurities is disclosed. The inclusion of solid particles, such as soot, carbon black, silica fines has been found to decrease the formation of sediment during the reaction process.

24 Claims, 2 Drawing Sheets

METHODS FOR ADDING VALUE TO HEAVY OIL

This application claims priority of U.S. Provisional application No. 60/026,193, filed Sep. 16, 1997.

BACKGROUND OF THE INVENTION

1. Field of the Invention

The present invention is generally related to the refining and processing of high density or heavy crude oil. More specifically, the invention pertains to an improved process for upgrading a heavy crude oil feedstock into an oil that is less dense or lighter that the original heavy crude oil feedstock.

2. Background

A variety of enhanced oil recovery (EOR) techniques permit the recovery of heavy oils from otherwise unproductive wells, including steam flooding, carbon dioxide flooding, and fire flooding. During EOR, a surfactant is typically used which causes the formation of underground oil/water emulsions. After being pumped to the surface, the oil and water portions of the emulsions are separated, after which the oil is passed on for further processing and the water is reused in the oil recovery operation.

Processes used in the upgrading of heavy oils to give lighter and more useful oils and hydrocarbons are generally of the carbon rejection or hydrogen addition type. Both procedures employ high temperatures (usually greater than 400° C.) to "crack" the long chains or branches of the hydrocarbons that make up the heavy oil. In the carbon rejection process, the heavy oil is converted to lighter oils and coke. The formation of coke is prevented, however, in the hydrogen addition process by the addition of high pressure hydrogen. In some carbon rejection processes, the coke is used elsewhere in the refinery to provide heat or fuel for other processes. Both processes result in an upgrading of the heavy oil feedstock to less dense or lighter oils and hydrocarbons.

A process for the thermal and catalytic rearrangement of heavy oils and other similar feedstocks is described by de Bruijn et al. in U.S. Pat. Nos. 5,104,516 and 5,322,617, the contents of which are hereby incorporated by reference. In the disclosed processes, a heavy oil/water or feedstock/water emulsion is reacted with synthesis gas in the presence of a catalyst to reduce the viscosity and density of heavy oil thus making it more amenable for transportation by a pipeline. The disclosed process provides for the recovery of hydrogen and carbon dioxide gases as by-products and the recycling of carbon monoxide back into the rearrangement process. Use of a bifunctional catalyst present in about 0.03 to about 15% under conditions and pressures that facilitate both the water gas shift reaction and the rearrangement of hydrocarbons is described. The bifunctional catalyst includes an inorganic base and a catalyst containing a transition metal such as iron, chromium, molybdenum or cobalt.

The water gas shift reaction is an industrial process in which carbon monoxide (CO) and water ($H_2O$), in the form of steam, are reacted in the presence of a catalyst to give carbon dioxide ($CO_2$) and hydrogen ($H_2$) as shown in the following equation:

$$CO(g)+H_2O(g) \leftrightarrow CO_2(g)+H_2(g)$$

In the process disclosed by de Bruijn et al. the water gas shift reaction is used to generate the hydrogen used to rearrangement of the hydrocarbons within the feedstock, and also to produce excess gas which is recovered as by-products. As disclosed, the source of CO may be carbon monoxide mixed with water, synthesis gas or generated in-situ from the decomposition of methanol.

Synthesis gas (syngas) is a mixture of hydrogen ($H_2$) and carbon monoxide (CO) typically in a range of ratios between about 0.9 to about 3.0. It is commonly made by the controlled combustion of methane, coal, or napthas with oxygen to give a mixture of gases including hydrogen ($H_2$), carbon monoxide (CO), carbon dioxide ($CO_2$), hydrogen sulfide ($H_2S$), carbonyl sulfide (COS), and others. It is conventional to "clean-up" the produced combustion gases to give pure synthesis gas. A critical prerequisite for the use of syngas in reactions catalyzed by transition metals is the removal of sulfur containing compounds, such as $H_2S$ or COS, formed from sulfur compounds in natural hydrocarbons or coal. In addition, soot generated during the combustion process is removed using water-based washing or scrubbing techniques thus cooling the syngas significantly.

The process disclosed by de Bruijn et al., also known as CANMET technology, suffers from significant deficiencies when practiced on an industrial scale. Specifically, the CANMET technology:

(1) Lacks a suitable source for synthesis gas within the process scheme;

(2) Generates waste products such as coke, heavy oil residues, and spent catalyst that must be disposed of in an environmentally conscious manner;

(3) Generates water highly contaminated with hydrocarbons that require significant treatment before being released to the environment;

(4) Requires an economic source of heat for the upgrading/rearrangement reactions;

(5) Prefers a separate sulfiding step to activate the catalysts utilized in the upgrading/rearrangement reactions;

(6) Is limited by the slow kinetics of the water gas shift reaction; and, (7) Has problems with the stability and breakdown of the heavy oil/water emulsion feedstock.

SUMMARY OF THE INVENTION

The present invention is directed to an improved process for upgrading a heavy crude oil into a lighter, low density oil. One embodiment of the inventive process involves creating a heavy oil and water feedstock emulsion; reacting the feedstock emulsion with a hydrogen containing gas in the presence of a catalytic amount of a transition metal catalyst, and optionally particulate fines, to give a product stream including a lighter oil, a heavy oil residue and a hydrocarbon contaminated water; and separating from the product stream the lighter oil, the heavy oil residue and the hydrocarbon contaminated water. In another embodiment of the inventive process a heavy oil and water feedstock emulsion is created and reacted with a crude, hot synthesis gas in the presence of a catalytic amount of a transition metal catalyst to give a product stream including a lighter oil, a heavy oil residue and a hydrocarbon contaminated water. The product stream is separated to give a lighter oil, a heavy oil residue and a hydrocarbon contaminated water. A second emulsion is formed between the heavy oil residue and the hydrocarbon contaminated water, the second emulsion being stabilized by surfactants. The heavy oil residue may optionally be processed in a high shear environment so as to reduce viscosity. The second emulsion is utilized as a feedstock in a partial oxidation unit to produce the crude, hot synthesis gas which is used as previously noted above.

The invention is also directed to a method of enhancing the stability of an emulsion of heavy oil and water and to the composition of the resulting stabilized heavy oil/water emulsion fuel.

BRIEF DESCRIPTION OF THE DRAWINGS

These and other features of the present invention are more fully set forth in the following description of illustrative embodiments of the invention. The description is presented with reference to the accompanying drawing in which.

DESCRIPTION OF ILLUSTRATIVE EMBODIMENTS

Figure 1:
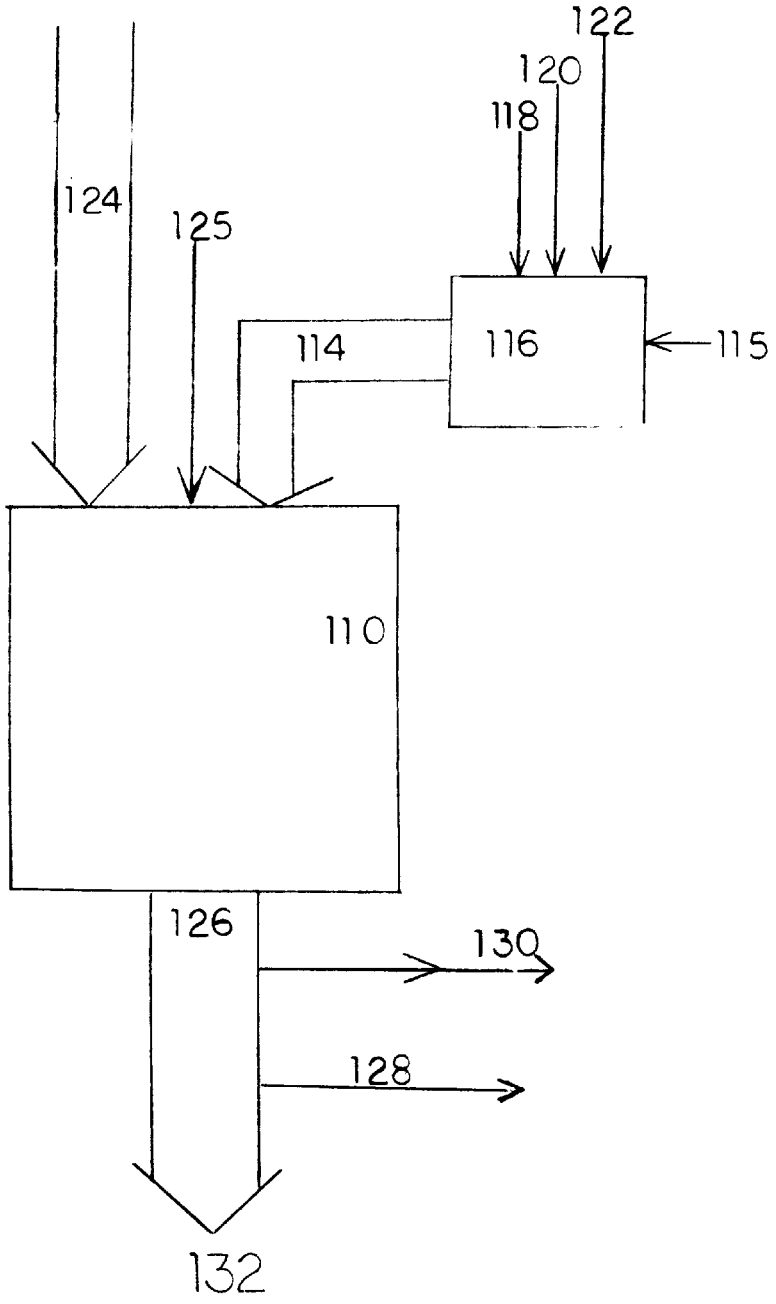
FIG. 1 is a schematic process flow diagram of a illustrative embodiment of the present invention utilizing a hydrogen containing gas.
Figure 2:
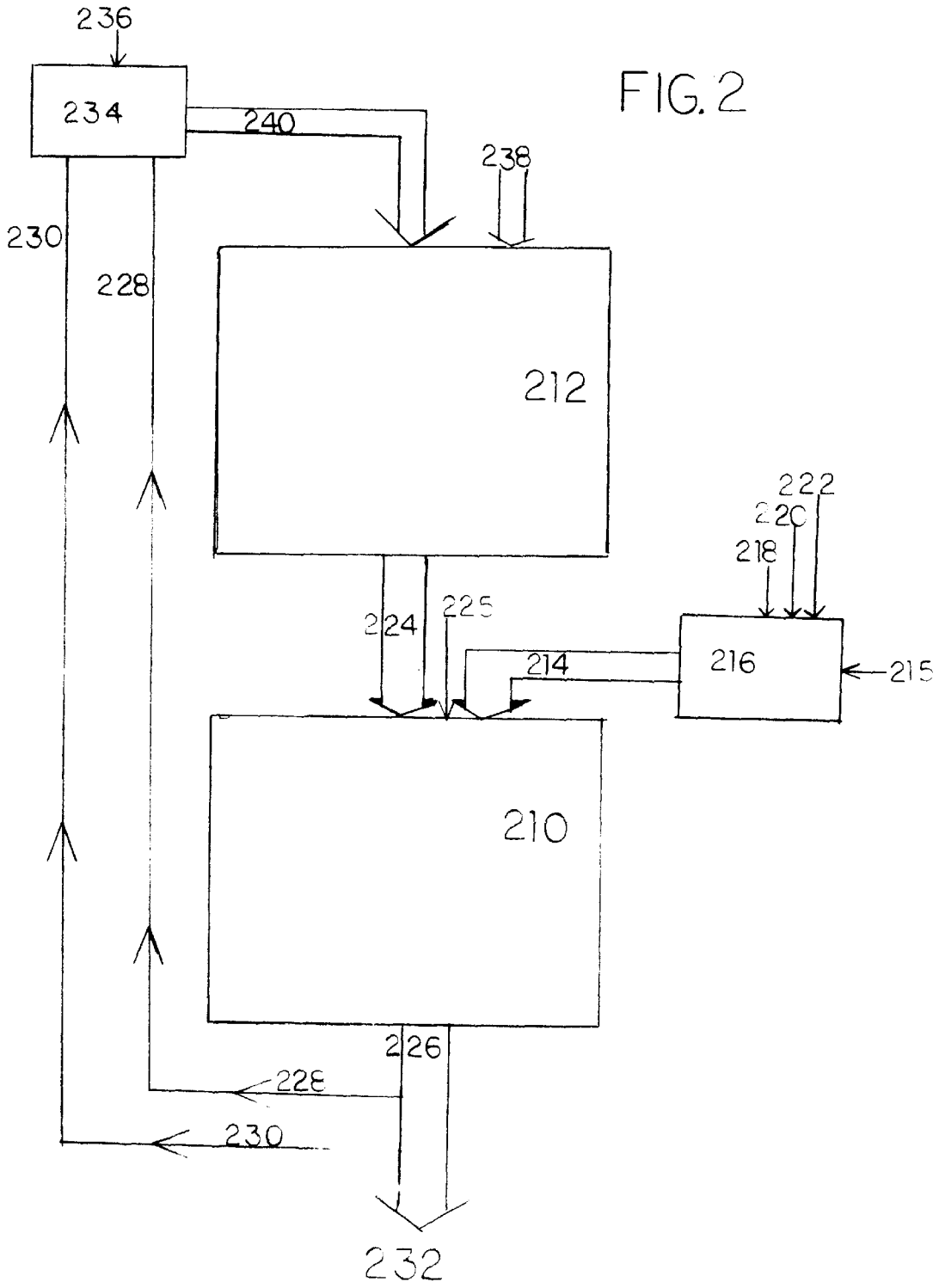
FIG. 2 is a schematic process flow diagram of a illustrative embodiment of the present invention utilizing hot crude synthesis gas.

Process flow diagrams of embodiments of the present invention are given in FIG. 1 and FIG. 2. In these flow diagrams, it should be understood that components, such as the upgrading unit (110 & 210), the emulsion mixer and preheater (116 & 216) and the partial oxidation/gasification unit (212), have been represented as boxes for the sake of simplicity of illustration. One of ordinary skill in the art should understand and appreciate that implementation of the actual process will be more detailed and will also depend upon the scale, cost, quality and quantity of feedstock, reactor pad space available and other factors.

Turning now to FIG. 1., a preheated heavy oil/water emulsion (114) is introduced into the upgrading unit (110) at an appropriate point depending upon unit design. The heavy oil/water emulsion is made in an emulsion mixer and preheater (116) into which heavy oil (118) and water (120) are mixed into an emulsion having a ratio of heavy oil to water in the range of between about 99.99:0.01 to about 70:30. Typically the heavy oil/water emulsion is preheated to a temperature in the range of between about 300° C. and 350° C. During this step it is believed that the water interacts with polar moieties of the heavy oil, thus at least partially upgrading the heavy oil. Further it is believed that during this step the heavy oil of the feedstock emulsion is prepared for the temperatures used in the upgrading reactor without coking or retrogressive reactions.

A surfactant or a mix of surfactants (122) may be included in the heavy oil/water feedstock emulsion to increase the stability of the emulsion. Suitable surfactants include both water and oil soluble surfactants. A suitable surfactant or mixture of surfactants include surfactants having a hydrophilic-lipophilic balance in the range of between about 2 and about 10 and mixtures thereof. When a single surfactant is used, sufficient amounts are used to obtain a stable emulsion. Typically this concentration of single surfactant falls in the range of between about 50 ppm and about 2% of the emulsion. It has been found that when a combination of surfactants is used, the total amount of surfactant added is typically less than the amount used for any single surfactant. Thus, when a combination of surfactants are used to achieve a stabilized emulsion, the total surfactant concentration typically falls in the range of between about 100 ppm and about 1% of the emulsion.

Hydrogen containing gas is (124) is introduced into the upgrading unit at an appropriate point. This hydrogen containing gas may be generated in another part of the refinery or it may be purchased "over the fence" from a vendor. Thus before introduction into the upgrading unit, such "over the fence" hydrogen should be preheated using suitable heating means known to one skilled in the art.

In one embodiment, the hydrogen containing gas (124) is hot, crude synthesis gas. As used herein, the term "hot, crude synthesis gas" is intended to mean a mixture of hydrogen ($H_2$) and carbon monoxide (CO) gases known in the art as synthesis gas or syngas which has not been conventionally processed. Synthesis gas may be produced in a partial oxidation unit or a gasification unit by the oxidation of a hydrocarbon fuel in the presence of oxygen or the partial oxidation of a hydrocarbon in the presence of steam. The resulting mixture of gases and soot particles exit the gasification unit at approximately 1482° C. (2700° F.) after which they are substantially cooled and processed to remove all but the $H_2$ and CO. In the context of the present invention and disclosure, however, this crude synthesis gas is cooled to a temperature appropriate to the operation of the upgrading unit. Thus in relation to conventional synthesis gas, the synthesis gas used in the process of the present invention can be characterized as being "crude and hot."

Within the upgrading unit (110), the heavy oil is converted into the desired light oil end product. The upgrading unit (110) itself may comprise either a single or multiple reactor units either in parallel or in series. In one preferred embodiment, the upgrading unit comprises two trains of two reactors in series. Typically, a supplementary charge of the heavy oil/water emulsion feedstock is injected into the reaction stream at a point between the series of reactors so that the two reactors operate at approximately the same temperature. The reactors are operated in the temperature range of between about 400° C. and about 440° C.; a pressure range of between about 400 psi and about 2000 psi and at a flow rate in the range of between about 5 gal./day and about 100,000 BBL/day. In one preferred embodiment, the reactor is designed for upflow operation with each reactor having its own inlet distributor system. Other reactor designs may be suitable and thus used within the scope of the present invention.

Complex chemical reactions occur inside the reactors that constitute the upgrading unit. However, the overall chemical reaction is represented by the following unbalanced general equation:

$$\text{Heavy oil} + H_2O + H_2 + CO \xrightarrow{\text{catalyst}} \text{Light oil} + H_2O + CO_2 + \text{Residue}$$

Although not intending to be limited by any particular theory, it is believed that two reactions are occurring within the upgrading unit reactors. The first is the water gas shift reaction discussed above. This reaction is used to generate in-situ hydrogen which is utilized in the hydrocracking of the hydrocarbons constituting the heavy oil. It is this second reaction, the hydrocracking of the hydrocarbons constituting the heavy oil, that is believed to generate a majority of the product light oil.

The catalyst (125) may be introduced into the reactors of the upgrading unit (110) in a number of ways including as a mixture with the heavy oil/water feedstock, co-injection with the heavy oil/water feedstock or direct injection into the upgrading reactor by itself.

The catalyst (125) used in the upgrading unit preferably contains a transition metal, transition metal-containing compound or mixtures thereof in which the transition metal is selected from the Group V, VI and VIII elements of the Periodic Table of Elements. More preferably, the transition metal is selected from the Group in which the metal is vanadium, molybdenum, iron, cobalt, nickel or combinations thereof. Both water soluble and oil soluble transition metal compounds may be used in the catalyst, including metal naphthanates, metal sulfates, ammonium salts of polymetal anions, MOLYVAN (TM) 855 a proprietary material containing 7 to 15% molybdenum commercially available from R. T. Vanderbilt Company, Inc. of Norwalk, Conn., molybdenum HEX-CEM which is proprietary mixture containing 15% molybdenum 2-ethylhexanote available from Mooney Chemicals, Inc. of Cleveland Ohio and other similar compounds. In addition, a transition metal-containing waste stream, for example, from a polyolefin/methyl t-butyl ether process containing between 2 and 10% molybdenum in an organic medium which principally is composed of molybdenum glycol ethers, is suitable as a source of catalyst. This latter compound may be purchased from Texaco Chemical Company, Port Neches Plant, Tex.

In one embodiment of the present invention, hydrogen sulfide offgas is recycled back into the process so as to presulfide the catalyst. In one such embodiment, at least a portion the hydrogen sulfide gas generated during the reaction product separation process is reintroduced into the upgrading unit. Preferably this hydrogen sulfide gas is mixed with the heavy oil and water emulsion prior to injection into the reactor. This presulfiding is believed to increase the yield of the desire light oil products boiling below 1000° F.

It has been found, that the use of a crude, hot synthesis gas containing soot particles introduces sufficient catalyst into the reactors of the upgrading unit. The addition of the soot particles, which may contain inorganics including nickel and vanadium, has been found to increase the yield, and decrease the density of the final light oil product. Experiments were conducted in which soot containing inorganic particles including nickel and vanadium was added to the synthesis gas used in the upgrading reaction in order to investigate the impact of the added soot on the heavy oil upgrading process. The starting material heavy oil typically has an API gravity of about 12.5 and a sulfur content of about 6.9%. Upon reaction of a portion of a heavy oil/water emulsion in the upgrading process of the present invention, in the presence of soot, a molybdenum based catalyst, such as the MOLYVAN (TM) family of catalysts, and a mixture containing vanadium and nickel compounds, the API gravity is increased to a value in the range of between about 22 and about 30 and the sulfur content is decreased to a value in the range of between about 2.0% to about 4.0%. However, upon reacting a second portion of the same heavy oil/water emulsion in the presence of only soot and the vanadium and nickel catalyst mixture, the API gravity increased to about the same degree and the sulfur content reduced to a similar range. These results clearly demonstrate that the use of gasification soot alone is able to upgrade the heavy oil without the need for supplemental catalyst.

In addition to the above described enhancement of the upgrading reaction, the inclusion of the soot particles with the synthesis gas eliminates the expensive soot removal step that is typically a part of the gasification process. Further, by using the soot as a catalyst in the upgrading reaction, the cost of disposing of the soot is saved.

As an alternative to or in addition to soot, other additives such as coke fines, coal fines, pure sand fines, iron oxide fines, modified iron oxide, activated carbon or mixtures thereof may be optionally added to enhance the upgrading reactions. As used herein, the term "fines" is used to describe particles having a size in the range of between about 0.01 $\mu$m ($1\times10^{-8}$ m) to about 0.5 mm ($5\times10^{-4}$ m) and preferably in the range of between about 1 $\mu$m ($1\times10^{-6}$ m) and 50 $\mu$m ($5.0\times10^{-5}$ m). This particulate matter (FIG. 1, number 115; FIG. 2, number 215), i.e. fines, may be added to the reaction mixture during the formation of the heavy oil/water emulsion (114 & 214 respectively) feedstock. It is believed that the addition of these additives leads to the improvement of the upgrading reactions by minimizing mesophase formation during the reactions. The fines provide sites for the formation of coke precursors so as to inhibit the growth of coke deposits on the reactor walls or pathways which may otherwise lead to reactor plugging.

A second benefit derived from the use of hot, crude synthesis is the in-situ activation and sulfiding of the transition metal catalyst. Sulfur containing gases in the synthesis gas, or offgas generated from the heavy crude may be used in this presulfiding step. Presulfiding has been found to improve the overall upgrading reaction chemistry. Experiments conducted in the absence and the presence of $H_2S$ or $CS_2$ in the reaction have shown that the presence of the sulfur compounds improves the quality of the light oil product, such as increased distillate yield and asphaltene content.

One skilled in the art will appreciate the cost and performance benefits of in-situ activation and sulfiding of the transition metal catalyst. Under the current state of the art, these steps are conducted as separate steps within the reactor or in a separate portion of the refinery facility. By conducting the activation/sulfiding step in-situ in accordance with the present invention, the reactor down-time needed to conduct the sulfiding steps in the upgrading reactor itself or the capital costs of separate facilities are eliminated. Additional cost savings may be realized by the elimination of the gas scrubbing steps conventionally conducted in the production of synthesis gas.

The upgrading unit product stream (126) is a mixture including heavy oil residues (128), hydrocarbon contaminated water (130), and light oil (132). Conventional separation technology may be used to separate the components of the upgrading unit product stream.

In a preferred embodiment of the present invention, the heavy oil residue and a portion of the hydrocarbon contaminated water are separated from the product stream in a hot separator and the light oil and the remaining hydrocarbon contaminated water are separated from each other in a cold separator. Useful gases derived from the separation process, including hydrogen, gaseous hydrocarbons, carbon monoxide, and carbon dioxide are recirculated and used in either the gasification unit or the upgrading unit.

The light oil (132) produced in the upgrading process may be stabilized by bubbling nitrogen or some other inert gas through it so as to remove any dissolved gases. The light oil product may be utilized elsewhere in the refinery facility, stored on-site for use at a later date, or shipped to another refinery site. The heavy oil residues (128) and the hydrocarbon contaminated water (130) may be conventionally stored on-site and disposed of in an environmentally conscious manner.

In another embodiment of the present invention, the heavy oil residue and hydrocarbon contaminate water wastestreams are recycled back into the upgrading process of the present invention or elsewhere in the refinery facility as shown in FIG. 2. It should be noted that components/elements/designations are the same as those utilized in FIG. 1, except that the number has been increased by 100, i.e. the upgrading unit in FIG. 1 is 110, whereas the upgrading unit in FIG. 2 is 210, and so forth. The heavy oil residues (228) and the hydrocarbon contaminated water waste streams are mixed together along with at least one surfactant (236) in a second emulsion mixer (234) to form a stabilized hydrocarbon contaminated water/heavy oil residue (HCW/HOR) emulsion fuel (240). The HCW/HOR emulsion fuel (240) can be used as at least a portion of the feedstock for the partial oxidation unit (212) also known as a gasification unit. One skilled in the art will understand that supplementary gasification fuel may be required by the gasification unit in order to generate sufficient amounts of crude, hot synthesis gas used in the upgrading unit 210.

In one such embodiment, the HCW/HOR emulsion fuel, a temperature moderator (if required e.g. $H_2O$, $CO_2$), and a stream of free-oxygen containing gas are introduced into the reaction zone of a free-flow unobstructed downflowing vertical refractory lined steel wall pressure vessel where the partial oxidation reaction takes place for the production of synthesis gas. A typical gas generator is shown and described in coassigned U.S. Pat. No. 3,544,291, which is incorporated herein by reference.

A two, three or four stream annular type burner, such as shown and described in coassigned U.S. Pat. Nos. 3,847,564, and 4,525,175, which are incorporated herein by reference, may be used to introduce the feedstreams into the partial oxidation gas generator. With respect to U.S. Pat. No. 3,847,564, free-oxygen containing gas, for example in admixture with steam, may be simultaneously passed through the central conduit and outer annular passage of the burner. The free-oxygen containing gas is selected from the group consisting of substantially pure oxygen i.e. greater than 95 mole % $O_2$, oxygen-enriched air i.e. greater than 21 mole % $O_2$, and air. The free-oxygen containing gas is supplied at a temperature in the range of about 100° F. to 1000° F. The HCW/HOR emulsion fuel is passed into the reaction zone of the partial oxidation gas generator by way of the intermediate annular passage at a temperature in the range of about ambient to 650° F. In another embodiment, a stream of vent gas may be simultaneously introduced into the free-flow gas generator by way of a separate passage in the burner and reacted by partial oxidation simultaneously with the partial oxidation reaction of the HCW/HOR emulsion fuel.

The burner assembly is inserted downward through a top inlet port of the noncatalytic synthesis gas generator. The burner extends along the central longitudinal axis of the gas generator with the downstream end discharging a multiphase mixture of fuel, free-oxygen containing gas, and temperature moderator such as water, steam, or $CO_2$ directly into the reaction zone.

The relative proportions of fuels, free-oxygen containing gas and temperature moderator in the feedstreams to the gas generator are carefully regulated to convert a substantial portion of the carbon in the fuel feedstream, e.g., up to about 90% or more by weight, to carbon oxides; and to maintain an autogenous reaction zone temperature in the range of about 1800° F. to 3500° F. Preferably the temperature in the gasifier is in the range of about 2400° F. to 2800° F., so that molten slag is produced. The pressure in the partial oxidation reaction zone is in the range of about 1 to 30 atmospheres. Further, the weight ratio of $H_2O$ to carbon in the feed is in the range of about 0.2–3.0 to 1.0, such as about 0.5–2.0 to 1.0. The atomic ratio of free-oxygen to carbon in the feed is in the range of about 0.8–1.5 to 1.0, such as about 0.9–1.2 to 1.0. By the aforesaid operating conditions, a reducing atmosphere comprising $H_2$+CO is produced in the reaction zone along with nontoxic slag.

The dwell time in the partial oxidation reaction zone is in the range of about 1 to 15 seconds, and preferably in the range of about 2 to 8 seconds. With substantially pure oxygen feed to the gas generator, the composition of the effluent gas from the gas generator in mole % dry basis may be as follows: $H_2$ 10 to 60, CO 20 to 60, $CO_2$ 5 to 60, $CH_4$ 0 to 5, $H_2S$+COS 0 to 5, $N_2$ 0 to 5, and Ar 0 to 1.5. With air feed to the gas generator, the composition of the generator effluent gas in mole % dry basis may be about as follows: $H_2$ 2 to 20, CO 5 to 35, $CO_2$ 5 to 25, $CH_4$ 0 to 2, $H_2S$+COS 0 to 3, $N_2$ 45 to 80, and Ar 0.5 to 1.5. Unconverted carbon, ash, or molten slag are contained in the effluent gas stream. The effluent gas stream is called crude synthesis gas and may be recycled without further processing in the above noted upgrading reaction.

Advantageously, in the extremely hot reducing atmosphere of the gasifier, the toxic elements in any inorganic matter from the fuel materials are captured by the noncombustible constituents present and converted into nontoxic nonleachable slag. This permits the nontoxic slag to be sold as a useful by-product. For example, the cooled slag may be ground or crushed to a small particle size e.g. less than ⅛" and used in road beds or building blocks.

Another facet of the present invention is the formulation of the HCW/HOR emulsion fuel used above as a feedstock for the gasification unit or as a fuel for a oxidation unit. It was found that to utilize this emulsion fuel as a feedstock, the emulsion needed to be stabilized. As used herein, a stabilized emulsion fuel is characterized by maintaining an emulsion state for at least 1 hour, however stable emulsions have been made with a stability of greater than 30 days.

In order to achieve stability in the HCW/HOR emulsion fuel, it was discovered that a mixture of surfactants is more effective at stabilizing the emulsion than current state of the art, single surfactant emulsions. The stabilized HCW/HOR emulsion fuel of the present invention is a mixture including hydrocarbon contaminated water, heavy oil or heavy oil residues and at least two surfactants in a sufficient amount to stabilize the emulsion. The water used in forming the HCW/HOR emulsion fuel typically contains dissolved hydrocarbons, or suspended oils or coke in the range of between about 10 ppm to about 20%. The heavy oil residue may be the actual sidestream residue generated from the above upgrading process or similar processes, heavy oil refinery waste, heavy oil itself or mixtures thereof. The water and oil components are mixed together in a ratio of oil to water in the range of about 99.99:0.01 to about 70:30 in the presence of a plurality of surfactants to achieve a stable emulsion. Suitable surfactants include sorbitan trioleate (Span 85), sorbitan tristearate (Span 65), sodium laurel sulfate, other similar surfactants with a hydrophilic-lipophilic balance in the range of between about 2 to about 10. The surfactants are blended together in a ratio in the range of between about 0.01 to about 0.99 before mixing with the emulsion.

In addition to the use of surfactants, it has been found that the stability of the HCW/HOR emulsion fuel is improved if the heavy oil residue is processed in an advance homogenizer. By processing the heavy oil residue in such a manner, agglomerations of asphaltenes and other sediments are reduced in size which increases stability of the HCW/HOR fuel. In one embodiment a 450X-series machine manufactured by Ross is utilized. Unlike traditional homogenizers, the X-Series rotor and stator is composed of a matrix of interlocking channels. With the rotor turning at high speeds (i.e. tip speeds as high as 17,000 rpm) the X-series machine can produce emulsions comparable to those produced by a high pressure homogenizer. As shown below in TABLE 1, this results in a significant reduction in the viscosity of the heavy oil residue.

TABLE 1

| | Time (s) | | | | |
|---|---|---|---|---|---|
| | 5 | 15 | 25 | 35 | 45 |
| Viscosity* (cP) of Unprocessed Heavy Oil Residue | 1300 | 1050 | 975 | 925 | 900 |
| Viscosity* (cP) of Processed Heavy Oil Residue | 200 | 200 | 190 | 190 | 190 |

*Viscosity measured using Bohlin Rheometer, 25° C.

Results generated using the above system on the heavy oil residue show a significant reduction in particle size of the asphaltenes and improved emulsion stability. The viscosity of the heavy oil residue is also improved as shown above which makes handling and storage much easier.

In one embodiment of the present invention at least a portion of the HCW/HOR emulsion fuel is utilized as a fuel for a combustion unit that in turn provides heat for the reforming unit. This is particularly advantageous when gasification or partial oxidation is not the preferred source of hydrogen containing gas. A conventional combustion unit is used for this process.

In yet another embodiment of the present invention, the fraction of the reaction product boiling below 1000° F. is subjected to hydrotreating, while it is still hot. This process may be refereed to as secondary hydrotreating or integrated hydrotreating. The hydrotreating of the fraction of reaction product boiling below 1000° F. is carried out using hydrotreating conditions, such as those described in co-assigned U.S. Pat. 5,436,215 the contents of which are hereby incorporated herein by reference. The hydrogenation process generally reacts the oil with hydrogen gas in the presence of a supported metal oxide catalyst under elevated temperatures and pressures. Catalysts which may be utilized in the integrated hydrotreating process of this embodiment may be selected for a number of commercial catalysts including Criterion TEX-2710 catalyst a commercially available molybdenum oxide/nickel oxide catalyst supported on alumnia and promoted with silica; Criterion HDS-2443 catalyst a commercially available molybdenum oxide/nickel oxide catalyst supported on alumnia and promoted with silica and phosphorous oxide; Criterion 424 catalyst a commercially available molybdenum oxide/nickel oxide catalyst supported on alumnia and promoted with phosphorous oxide and other similar such catalysts. All of the proceeding catalysts are available from Criterion Catalysts of Houston Tex.

The following examples are included to demonstrate embodiments of the invention. It should be appreciated by those of skill in the art that the techniques disclosed in the examples which follow represent techniques discovered by the inventors to function well in the practice of the invention, and thus can be considered to constitute preferred modes for its practice. However, those of skill in the art should, in light of the present disclosure, appreciate that many changes can be made in the specific embodiments which are disclosed and still obtain a like or similar result without departing from the spirit and scope of the invention.

In the following Examples, the heavy oil feed was an Eocene oil having the characteristics shown in Table 2. below:

TABLE 2

| Total Oil Composition: Feed Eocene Oil | |
|---|---|
| Density (API gravity) | 13.1 |
| % Total Distillates (BP < 524° C.) | 49.0% |
| % Asphaltenes | 10.9% |
| Fe (ppm) | 3.3 |
| V (ppm) | 73.0 |
| Ni (ppm) | 27.6 |
| Cr (ppm) | 8.1 |
| S (% wt) | 6.57 |

Example 1

Feed Eocene oil was emulsified with 10% water utilizing Span 65 and Span 85 as an emulsifier to stabilize the emulsion. To this mixture a sufficient amount of iron naphthanate, an oil soluble catalyst, and MOLYVAN (TM) were added to give a concentration of 100 ppm and 200 ppm respectively of each catalyst within the emulsion. In addition carbon powder was added to achieve a concentration of about 1000 ppm. The emulsion was reacted in a bench scale upflow tubular reactor with an equal mixture of carbon monoxide and hydrogen gas and a temperature of about 425° C. and a pressure of about 1400 psig. The gas was introduced at a rate of about 500 sccm. Additional conditions are given below in Table 3.

TABLE 3

| Conditions | Run # 118.7126.1 | Run #118.7126.2 |
|---|---|---|
| Run length (hr.) | 2 | 4 |
| LHSV | 0.82 | 0.7 |
| Pump Speed (cc/min) | 1.75 | 1.5 |
| Feed oil (ml) | 210 | 180 |
| Gas Volume ($cm^3$) | 58.97 | 62.13 |
| Plugging | NO | NO |

The resulting light oil product was separated from the reaction product to give an oil having the properties in Table 4.

TABLE 4

| Properties | Run # 118.7126.1 | Run #118.7126.2 |
|---|---|---|
| Liquid Product | | |
| Total Weight (gm) | 190.3 | 158.7 |
| Density (API gravity) | 22.3 | 22.0 |
| % Total Distillates (BP < 524° C.) | 80 | 84.5 |
| % Desulfurization | 45.4 | 49.2 |
| % Asphaltenes | 4.9 | 3.5 |
| Fe (ppm) | 2 | 2 |
| V (ppm) | 44.7 | 45 |
| Ni (ppm) | 16.6 | 14.1 |
| Cr (ppm) | 5 | 5 |
| Gas Product $H_2S$ (wt %) | 4.56 | 4.23 |

Upon review of the above, one of ordinary skill in the art should note that the API gravity of the liquid product is significantly increased indicating a lighter oil product. In addition a beneficial decrease in the asphaltene concentration and the concentration of both sulfur and metals is observed.

Example 2

Feed Eocene oil was emulsified with 10% water utilizing Span 65 and Span 85 as an emulsifier to stabilize the emulsion. To this mixture a sufficient amount of MOLYVAN (TM) was added to give a concentration of 200 ppm of the catalyst within the emulsion. In addition carbon powder was added to achieve a concentration of about 1000 ppm. The emulsion was reacted in a bench scale upflow tubular reactor with an equal mixture of carbon monoxide and hydrogen gas and a temperature of about 425° C. and a pressure of about 1400 psig. The gas was introduced at a rate of about 500 sccm. Additional conditions are given below in Table 5.

TABLE 5

| Conditions | Run # 119.7156.1 | Run #119.7156.2 |
|---|---|---|
| Run length (hr.) | 2 | 4 |
| LHSV | 0.82 | 0.7 |
| Pump Speed (cc/min) | 1.75 | 1.5 |
| Feed oil (ml) | 210 | 180 |
| Gas Volume ($cm^3$) | 60.61 | 64.04 |
| Plugging | No | No |

The resulting product was separated to give an oil and gaseous products having the properties in Table 6.

TABLE 6

| Properties | Run # 118.7126.1 | Run #118.7126.2 |
|---|---|---|
| Liquid Product | | |
| Total Weight (gm) | 178.8 | 149.2 |
| Density (API gravity) | 22.0 | 26.7 |
| % Total Distillates (BP < 524° C.) | 81 | 88.5 |
| % Desulfurization | 45.7 | 51.4 |
| % Asphaltenes | 5.1 | 2.9 |
| Fe (ppm) | 2 | 2 |
| V (ppm) | 49.4 | 35.7 |
| Ni (ppm) | 17.5 | 10.7 |
| Cr (ppm) | 5 | 5 |
| Gas Product $H_2S$ (wt %) | 4.51 | 3.96 |

Upon review of the above, one of ordinary skill in the art should note that the API gravity of the liquid product is significantly increased indicating a lighter oil product. In addition a beneficial decrease in the asphaltene concentration and the concentration of both sulfur and metals is observed.

Example 3

Feed Eocene oil was emulsified with 10% water utilizing Span 65 and Span 85 as an emulsifier to stabilize the emulsion. To this mixture a sufficient amount of iron naphthanate, an oil soluble catalyst, and MOLYVAN (TM) were added to give a concentration of 100 ppm and 200 ppm respectively of each catalyst within the emulsion. In addition silica sand was added to achieve a concentration of about 1000 ppm. The emulsion was reacted in a bench scale upflow tubular reactor with an equal mixture of carbon monoxide and hydrogen gas and a temperature of about 425° C. and a pressure of about 1400 psig. The gas was introduced at a rate of about 500 sccm. Additional conditions are given below in Table 7.

TABLE 7

| Conditions | Run # 118.7126.1 | Run #118.7126.2 |
|---|---|---|
| Run length (hr.) | 2 | 4 |
| LHSV | 0.82 | 0.7 |
| Pump Speed (cc/min) | 1.75 | 1.5 |
| Feed oil (ml) | 210 | 180 |
| Gas Volume ($cm^3$) | 58.91 | 59.7 |
| Plugging | NO | NO |

The resulting light oil product was separated from the reaction product to give an oil having the properties in Table 8.

TABLE 8

| Properties | Run # 118.7126.1 | Run #118.7126.2 |
|---|---|---|
| Liquid Product | | |
| Total Weight (gm) | 187 | 159.9 |
| Density (API gravity) | 23.0 | 23.1 |
| % Total Distillates (BP < 524° C.) | 77 | 77.5 |
| % Desulfurization | 48.2 | 48.7 |
| % Asphaltenes | 4.9 | 4.6 |
| Fe (ppm) | 2 | 2 |
| V (ppm) | 36.3 | 40.3 |
| Ni (ppm) | 14.3 | 15.9 |
| Cr (ppm) | 5 | 5 |
| Gas Product $H_2S$ (wt %) | n/a | 4.66 |

Upon review of the above, one of ordinary skill in the art should note that the API gravity of the liquid product is significantly increased indicating a lighter oil product. In addition a beneficial decrease in the asphaltene concentration and the concentration of both sulfur and metals is observed.

Example 4

Feed Eocene oil was emulsified with 10% water utilizing Span 65 and Span 85 as an emulsifier to stabilize the emulsion. To this mixture a sufficient amount of MOLYVAN (TM) 885 was added to give a concentration of 1000 ppm of the catalyst within the emulsion. Particulate solids were not added to the reaction feed. The emulsion was reacted in a bench scale upflow tubular reactor with an equal mixture of carbon monoxide and hydrogen gas and a temperature of about 425° C. and a pressure of about 1400 psig. The gas was introduced at a rate of about 500 sccm. Additional conditions are given below in Table 9.

TABLE 9

| Conditions | Run # 117.7106.1 | Run #117.7106.2 |
|---|---|---|
| Run length (hr.) | 1.5 | 3 |
| LHSV | 0.82 | 0.7 |
| Pump Speed (cc/min) | 1.75 | 1.5 |
| Feed oil (ml) | 157.5 | 135 |
| Gas Volume ($cm^3$) | 38.42 | 37.72 |
| Plugging | NO | NO |

The resulting light oil product was separated from the reaction product to give an oil having the properties in Table 10

TABLE 10

| Properties | Run # 117.7106.1 | Run #117.7106.2 |
|---|---|---|
| Liquid Product | | |
| Total Weight (gm) | 143 | 123.8 |
| Density (API gravity) | 22.5 | 24.0 |
| % Total Distillates (BP < 524° C.) | 79 | 84 |
| % Desulfurization | 45.5 | 49.9 |
| % Asphaltenes | 5.8 | 3.7 |
| Fe (ppm) | 2 | 2 |
| V (ppm) | 48 | 28.8 |
| Ni (ppm) | 17.6 | 11.6 |
| Cr (ppm) | 5 | 5 |
| Gas Product $H_2S$ (wt %) | 2.60 | 2.57 |

Upon review of the above, one of ordinary skill in the art should note that the API gravity of the liquid product is significantly increased indicating a lighter oil product. In addition a beneficial decrease in the asphaltene concentration and the concentration of both sulfur and metals is observed.

Example 5

The following is a control example in which neither soluble catalyst nor particulate fines were included in the reactor feed. Feed Eocene oil was emulsified with 10% water utilizing Span 65 and Span 85 as an emulsifier to stabilize the emulsion. The emulsion was reacted in a bench scale upflow tubular reactor with an equal mixture of carbon monoxide and hydrogen gas and a temperature of about 425° C. and a pressure of about 1400 psig. The gas was introduced at a rate of about 500 sccm. Additional conditions are given below in Table 11.

TABLE 11

| Conditions | Run 121-7256.1 | Run 121-7256.2 | Run 121-7256.3 |
|---|---|---|---|
| Run length (hr.) | 1.3 | 2.6 | 4 |
| LHSV | 0.94 | 0.82 | 0.7 |
| Pump Speed (cc/min) | 2 | 1.75 | 1.5 |
| Feed oil (ml) | 156 | 136.5 | 120 |
| Gas Volume ($cm^3$) | 45.75 | 45.41 | 41.75 |
| Plugging | YES | YES | YES |

The resulting light oil product was separated from the reaction product to give an oil having the properties in Table 12.

TABLE 12

| Properties | Run 121-7256.1 | Run 121-7256.2 | Run 121-7256.3 |
|---|---|---|---|
| Liquid Product | | | |
| Total Weight (gm) | 145.7 | 112.8 | 108.8 |
| Density (API gravity) | 23.6 | 27 | 27.1 |
| % Total Distillates (BP < 524° C.) | 84 | 89.5 | 90 |
| % Desulfurization | 48.9 | 54.3 | 53.6 |
| % Asphaltenes | 6 | 3 | 2.7 |
| Fe (ppm) | 2 | 2 | 2 |
| V (ppm) | 40.7 | 15.6 | 15.4 |
| Ni (ppm) | 15.7 | 6.2 | 5.5 |

TABLE 12-continued

| Properties | Run 121-7256.1 | Run 121-7256.2 | Run 121-7256.3 |
|---|---|---|---|
| Cr (ppm) | 5 | 5 | 5 |
| Gas Product $H_2S$ (wt %) | 2.55 | 2.88 | 2.53 |

Upon review of the above, one of ordinary skill in the art should note that the reactor exhibits plugging due to the formation of sediment deposits inside the reactor. The formation of sediment deposits is undesirable because the build up of deposits changes the reactor volume and conditions o the reaction potentially creating a hazardous situation. In addition, if the reactor is to be run on a large industrial scale, periodic maintenance in order to clean the reactor would require considerable non-productive time periods.

Spectroscopic characterization of the products of Example 4 and Example 5 were conducted utilizing $^1H$ nuclear magnetic resonance (NMR). Table 13 compares the impact of the catalyst on the composition, in particular the degree of saturation of the upgraded product.

TABLE 13

| Run # | 117-1 | 121-1 | 117-2 | 121-2 |
|---|---|---|---|---|
| Catalyst | Yes | No | Yes | No |
| Total Aliphatic H | 94.0 | 92.0 | 93.7 | 91.9 |
| Total Olefinic H | 0.3 | 0.7 | 0.4 | 0.5 |
| Total Aromatic H | 5.7 | 7.3 | 5.9 | 7.6 |
| Hetero-Aromatic H | 0.2 | 0.2 | 0.1 | 0.2 |
| Tri-Aromatic H | 0.6 | 0.6 | 0.6 | 0.7 |
| Di-Aromatic H | 1.9 | 1.9 | 2.0 | 2.2 |
| Mono-Aromatic H | 3.0 | 4.5 | 3.2 | 4.6 |
| α-H | 11.8 | 13.5 | 11.9 | 13.8 |
| α-$CH_2$ | 7.8 | 8.0 | 7.8 | 8.2 |
| α-$CH_3$ | 3.6 | 5.0 | 3.7 | 5.1 |
| β-H | 56.7 | 53.0 | 56.4 | 52.8 |
| β-$CH_2$ | 13.1 | 13.1 | 12.6 | 12.4 |
| Paraffinic $CH_2$ | 43.6 | 39.9 | 43.8 | 40.3 |
| γ-H | 25.5 | 25.6 | 25.4 | 25.3 |

Upon review of the above results, one of skill in the art should observe that the presence of the catalyst is helpful in saturating the olefin and aromatic components of the oil thus yielding a higher total aliphatic content in the total liquid products. In contrast the runs in which the catalyst was not present generated significant amounts of coke and sediment which as previously noted leads to reactor plugging.

Example 6

Feed Eocene oil was emulsified with 10% water utilizing Span 65 and Span 85 as an emulsifier to stabilize the emulsion. To this mixture a sufficient amount of MOLYVAN (TM) was added to give a concentration of 1000 ppm of the catalyst within the emulsion. In addition, a polymerized dimethyl silicone fluid antifoaming agent, Dow Corning 200 Fluid available from Dow Corning, was added to the reactor feed in an amount to give a 100 ppm concentration. Particulate solids were not added to the reactor feed. The emulsion was reacted in a bench scale upflow tubular reactor with an equal mixture of carbon monoxide and hydrogen gas and a temperature of about 425° C. and a pressure of about 1400 psig. The gas was introduced at a rate of about 500 sccm. Additional conditions are given below in Table 14.

TABLE 14

| Conditions | Run # 122-8086.1 | Run #122-8086.2 |
|---|---|---|
| Run length (hr.) | 1.5 | 3 |
| LHSV | 0.82 | 0.7 |
| Pump Speed (cc/min) | 1.75 | 1.5 |
| Feed oil (ml) | 157.5 | 135 |
| Gas Volume (cm) | 38.42 | 37.78 |
| Plugging | NO | NO |

The resulting light oil product was separated from the reaction product to give an oil having the properties in Table 15.

TABLE 15

| Properties | Run # 122-8086.1 | Run #122-8086.2 |
|---|---|---|
| Liquid Product | | |
| Total Weight (gm) | 148 | 123.8 |
| Density (API gravity) | 21.3 | 23.6 |
| % Total Distillates (BP < 524° C.) | n/a | n/a |
| % Desulfurization | 44.0 | 45.2 |
| % Asphaltenes | n/a | n/a |
| Fe (ppm) | 2 | 2 |
| V (ppm) | 55.4 | 46.4 |
| Ni (ppm) | 20.8 | 15.1 |
| Cr (ppm) | 5 | 5 |
| Gas Product $H_2S$ (wt %) | 3.41 | 2.99 |

Upon review of the above, one of ordinary skill in the art should note that the API gravity of the liquid product is significantly increased indicating a lighter oil product. In addition a beneficial decrease in the asphaltene concentration and the concentration of both sulfur and metals is observed. In addition, the presence of the MOLYVAN catalyst in the reactor feed helps to prevent the formation of sediment in the reactor.

Example 7

As a comparison of the present invention with that utilizing a solid catalyst, then following example was carried out. Feed crude having an API gravity of 12.5 and 6.9% sulfur was mixed one of three catalyst and introduced into a bench scale upflow tubular reactor as described in the previous Examples. The reactions were carried out at 425° C., a pressure of 1000 psig and using a 1:1 mixture of $H_2$:CO. TABLE 16 below presents a comparison of the effect of each type of catalyst.

TABLE 15

| Catalyst | API gravity | % S (by weight) |
|---|---|---|
| $Fe_2O_3$, solid (1% wt) | 23.1 | 3.85 |
| $Fe_2O_3/SO_4$ (0.5% wt) | 25.2 | 3.59 |
| Iron Naphthanate (250 ppm) | 23.3 | 3.32 |

One skilled in the art should recognize that the use of the oil soluble catalyst (iron naphthanate) in the absence of other particulate solids, gives a product with an API and sulfur content comparable to the product resulting from the use of conventional solid catalysts.

Example 8

Example 7 was repeated except that two different oil soluble catalysts were compared in the absence of particulate solids. The results are given in TABLE 16 below

TABLE 16

| Catalyst | API gravity | % S (by weight) |
|---|---|---|
| Starting material | 12.5 | 6.9 |
| Mo as MOLYVAN (250 ppm) | 27.5 | 2.96 |
| Iron Naphthanate (250 ppm) | 23.3 | 3.32 |

Upon review of the above results, one of skill in the art should recognize that the molybdenum based oil soluble catalyst was slightly more active than the iron based oil soluble catalyst even in the absence of particulate solids.

Example 9

An embodiment of the present invention was carried out in which condition of pressure and the ratio of hydrogen to carbon monoxide were changed. Feed crude having an API gravity of 12.5 and 6.9% sulfur was mixed with 250 ppm of MOLYVAN and iron naphthanate and 6% water and introduced into a bench scale upflow tubular reactor as described in the previous Examples. The reactions were carried out under the condition noted below in TABLE 17 along with the properties of the reaction product.

TABLE 17

| | Pilot Run #36 | Pilot run#39 |
|---|---|---|
| H2:CO ratio | 1:1 | 3:1 |
| Temperature | 430° C. | 425° C. |
| Pressure | 1100 psig | 1300 psig |
| Properties of Product | | |
| % wt Sulfur | 3 | 3.19 |
| API gravity | 25.8 | 23 |
| Distillate Fraction: (% volume) | | |
| IBP–350° F. | 10.8 | 8.3 |
| 350–500° F. | 19.9 | 16.7 |
| 500–650° F. | 24.4 | 21.3 |
| 650–1000° F. | 31.8 | 34.6 |
| 1000° F.+ | 13.1 | 19.1 |

In general, the products generated during run #36 showed a slightly improved API gravity over that generated by run #39. The former, however, was operated at 430° C. compared to 425° C. used for run #39. In addition, review of the data show that about 75% of the total liquid product has an API gravity of 30 or above.

While the compositions and methods of this invention have been described in terms of preferred embodiments, it will be apparent to those of skill in the art that variations may be applied to the process described herein without departing from the concept, spirit and scope of the invention. All such similar substitutes and modifications apparent to those skilled in the art are deemed to be within the spirit, scope and concept of the invention as it is set out in the following claims.

What is claimed is:

1. A process for the upgrading of heavy oil feed into a lighter oil product, the lighter oil product having a density less than that of the heavy oil feed, comprising creating a first emulsion including the heavy oil feed and water;

reacting the first emulsion with crude synthesis gas in the presence of a catalytic amount of a catalyst, the catalyst being able to promote both the water gas shift reaction and the hydrocracking of the heavy oil feed into the lighter oil product, to give a reaction product stream;

separating the reaction product stream into fractions including a lighter oil product stream, a heavy oil residue stream and a hydrocarbon containing water stream;

creating a second emulsion including the heavy oil residue stream and the hydrocarbon containing water stream; and at least partially oxidizing the second emulsion to produce the crude hot, synthesis gas used above.

2. The process of claim 1 wherein the lighter oil has an API gravity value of at least 5 greater than that of the heavy oil feed.

3. The process of claim 1 wherein the catalyst comprises a transition metal compound.

4. The process of claim 3 wherein the transition metal is selected from the group comprising molybdenum, iron, cobalt, nickel, vanadium and combinations thereof.

5. The process of claim 4 wherein the catalyst is selected from iron naphthanate salts, ammonium molybdate molybdenum 2-ethylhexanoate, molybdenum glycol ether mixtures and mixtures thereof.

6. The process of claim 1 wherein the first emulsion further includes an emulsifying agent having an HLB from about 2 to about 10.

7. The process of claim 1 wherein the first emulsion further includes solid particles of a size so that they may be suspended in the emulsion.

8. The process of claim 7 wherein the solid particles are selected from gasifier soot, carbon black, silica fines, activated carbon iron oxide, modified iron oxide or mixtures thereof.

9. The process of claim 1 wherein the crude synthesis gas includes fine particles of soot or other solid materials resulting from gasification of heavy oil or an emulsion of heavy oil residue and hydrocarbon containing water.

10. A process for the thermal rearrangement of the hydrocarbon components of a feedstock oil and water emulsion comprising reacting the feedstock oil and water emulsion with synthesis gas in the presence of a catalytic amount of a bifunctional catalyst, the bifunctional catalyst being able to promote the water gas shift reaction and the hydrogenation reaction of the hydrocarbon components of the heavy oil, to give a reaction product; and recovering from the reaction product a liquid oil having an API gravity value greater than that of the feedstock oil.

11. The process of claim 10 wherein the synthesis gas utilized in the process is includes soot particles.

12. The process of claim 10 wherein the bifunctional catalyst is a transition metal compound that is at least partially soluble in the feedstock oil and water emulsion.

13. The process of claim 12 wherein the transition metal is selected from the group comprising molybdenum, iron, cobalt, nickel, vanadium and combinations thereof.

14. The process of claim 12 wherein the transition metal compound is from iron naphthanate salts, ammonium molybdate, molybdenum 2-ethylhexanoate, molybdenum glycol ether mixtures and mixtures thereof.

15. The process of claim 10 wherein the feedstock oil and water emulsion is stabilized by the presence of an emulsifier having an HLB value from about 2 to about 10.

16. The process of claim 15 wherein the feedstock oil and water emulsion further includes solid particles that are capable of being suspended in the emulsion.

17. The process of claim 16 wherein the solid particles include gasifier soot, carbon black, silica fines, activated carbon, iron oxide, modified iron oxide and combinations thereof.

18. The process of claim 10 wherein the liquid oil recovered from the reaction product undergoes integrated hydrotreating with hydrogen.

19. A process of treating a hydrocarbon feedstock to give an hydrocarbon product that has an API gravity value greater than that of the hydrocarbon feedstock, said process comprising:

creating a first emulsion, said first emulsion including the hydrocarbon feedstock, water and an emulsifying agent, said emulsifying agent having an HLB value from about 2 to about 10;

reacting the first emulsion with synthesis gas in the presence of a transition metal catalyst, said synthesis gas including soot particles, and other impurities formed during the generation of the synthesis gas, to give a reaction product;

recovering from the reaction product the hydrocarbon product, a heavy oil residue and hydrocarbon containing water;

creating a second emulsion including the heavy oil residue, the hydrocarbon containing water, and an emulsifier, said emulsifier having an HLB value from about 2 to about 10;

reacting the second emulsion in a partial oxidation unit to give a synthesis gas including soot particles and other impurities formed during the generation of the synthesis gas; and, recycling said synthesis gas as at least a portion of the synthesis gas utilized in the reaction with the first emulsion.

20. The process of claim 19 wherein the transition metal catalyst is selected so that the catalyst is a bifunctional catalyst and is capable of promoting the water gas shift reaction and the hydrogenation reaction of the hydrocarbon feedstock.

21. The process of claim 19 wherein the transition metal catalyst is selected from the group consisting of: iron naphthanate salts, ammonium molybdate, molybdenum 2-ethylhexanoate, molybdenum glycol ether mixtures and mixtures thereof.

22. The process of claim 19 further comprising passing the heavy oil residue through a high speed homogenizer so as to decrease the size of the asphaltene conglomerates or other solids in the heavy oil residue thus increasing the stability of the emulsion.

23. The process of claim 19 further comprising utilizing a portion of the second emulsion as fuel in a combustion unit used to heat the process.

24. The process of claim 1 further comprising reacting the light oil product with a hydrogen containing gas in the presence of a hydrotreating catalyst and under conditions for hydrotreating said light oil product.

* * * * *